US010836165B2

(12) United States Patent
Shimosato

(10) Patent No.: US 10,836,165 B2
(45) Date of Patent: Nov. 17, 2020

(54) FLUID DISCHARGE HEAD AND FLUID DISCHARGE APPARATUS

(71) Applicant: TOSHIBA TEC KABUSHIKI KAISHA, Tokyo (JP)

(72) Inventor: Masashi Shimosato, Mishima Shizuoka (JP)

(73) Assignee: TOSHIBA TAC KABUSHIKI KAISHA, Toyko (JP)

( * ) Notice: Subject to any disclaimer, the term of this patent is extended or adjusted under 35 U.S.C. 154(b) by 40 days.

(21) Appl. No.: 16/199,399

(22) Filed: Nov. 26, 2018

(65) Prior Publication Data

US 2019/0193399 A1 Jun. 27, 2019

(30) Foreign Application Priority Data

Dec. 22, 2017 (JP) ..... 2017-246379

(51) Int. Cl.
*B41J 2/14* (2006.01)

(52) U.S. Cl.
CPC ..... *B41J 2/14209* (2013.01); *B41J 2/14072* (2013.01); *B41J 2002/14258* (2013.01); *B41J 2002/14491* (2013.01)

(58) Field of Classification Search
CPC .. B41J 2/1433; B41J 2/14072; B41J 2/14209; B41J 2002/14411; B41J 2002/14491; B41J 2/14233; B41J 2/01; B41J 2/145; B41J 2002/14258
See application file for complete search history.

(56) References Cited

U.S. PATENT DOCUMENTS 8,714,715 B2 5/2014 Koseki
2011/0292115 A1 12/2011 Koseki
2014/0118440 A1 5/2014 Kubota
2014/0218444 A1 8/2014 Harajiri et al.
2015/0035908 A1* 2/2015 Domae ..... B41J 2/14201 347/68
2017/0334204 A1 11/2017 Shimosato

FOREIGN PATENT DOCUMENTS

| | | |
|---|---|---|
| EP | 2390095 | 11/2011 |
| EP | 2803486 | 11/2014 |
| JP | 2012-11704 | 1/2012 |
| JP | 2014-226789 | 12/2014 |

OTHER PUBLICATIONS

Extended European Search Report for European Patent Application No. 18211078.3 dated Apr. 24, 2019.

* cited by examiner

*Primary Examiner* — Henok D Legesse
(74) *Attorney, Agent, or Firm* — Amin, Turocy & Watson, LLP

(57) ABSTRACT

A fluid discharge head according to an embodiment includes abase including a plurality of first grooves disposed side by side in a first direction and a plurality of second grooves disposed side by side in the first direction and respectively disposed among the plurality of first grooves, an individual wire including individual electrodes formed in the second grooves, the individual wire being extended to one side in a second direction crossing the first direction, a common wire including common electrodes formed in the first grooves, the common wire being extended to the other side in the second direction, a connection wire connected to the common wire on the other side in the second direction and leading to the one side, and a nozzle plate including nozzles that communicate with the first grooves of the base.

20 Claims, 7 Drawing Sheets

FLUID DISCHARGE HEAD AND FLUID DISCHARGE APPARATUS

CROSS-REFERENCE TO RELATED APPLICATION

This application is based upon and claims the benefit of priority from Japanese Patent Application No. P2017-246379, filed Dec. 22, 2017, the entire contents of which are incorporated herein by reference.

FIELD

Embodiments described herein relate generally to a fluid discharge head and a fluid discharge apparatus.

BACKGROUND

In a fluid discharge head of a share-mode shared-wall scheme including a plurality of pressure chambers, there is known a configuration alternately including, in a predetermined direction, a plurality of pressure chambers, which communicate with nozzles, and air chambers disposed among the pressure chambers. In such a fluid discharge head, there is known a configuration in which, in order to prevent deficiencies due to an electric current flowing to fluid, common electrodes to be grounded are respectively formed in the pressure chambers, individual electrodes are respectively formed in the air chambers, and the common electrodes and the individual electrodes are mounted on a driving circuit.

Related art is described in, for example, JP-A-2013-10211.

DETAILED DESCRIPTION

An object is to provide a fluid discharge head and a fluid discharge apparatus in which wiring can be simplified.

A fluid discharge head according to an embodiment includes: a base including a plurality of first grooves disposed side by side in a first direction and a plurality of second grooves disposed side by side in the first direction and respectively disposed among the plurality of first grooves; an individual wire including individual electrodes formed in the second grooves, the individual wire being extended to one side in a second direction crossing the first direction; a common wire including common electrodes formed in the first grooves, the common wire being extended to another side in the second direction; a connection wire connected to the common wire on the other side in the second direction and leading to the one side; and a nozzle plate including nozzles that communicate with the first grooves of the base.

An inkjet head 1, which is a fluid discharge head, and an inkjet printer 100, which is a fluid discharge apparatus, according to a first embodiment are explained below with reference to FIGS. 1 to 7. In the figures, for explanation, components are enlarged, reduced, or omitted as appropriate. In the figures, arrows X, Y, and Z indicate three directions orthogonal to one another. In this embodiment, an example is explained in which a first direction, a second direction, and a third direction of the inkjet head 1 are respectively disposed along a X axis, a Y axis, and a Z axis.

Figure 1:
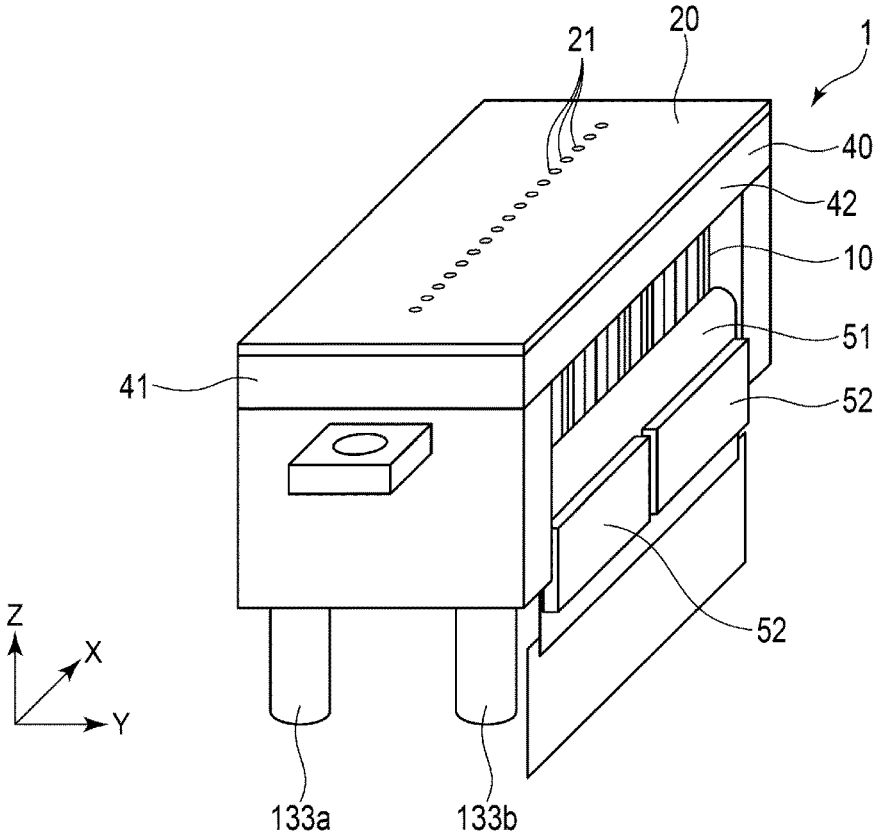
FIG. 1 is a perspective view of an inkjet head according to a first embodiment.
Figure 2:
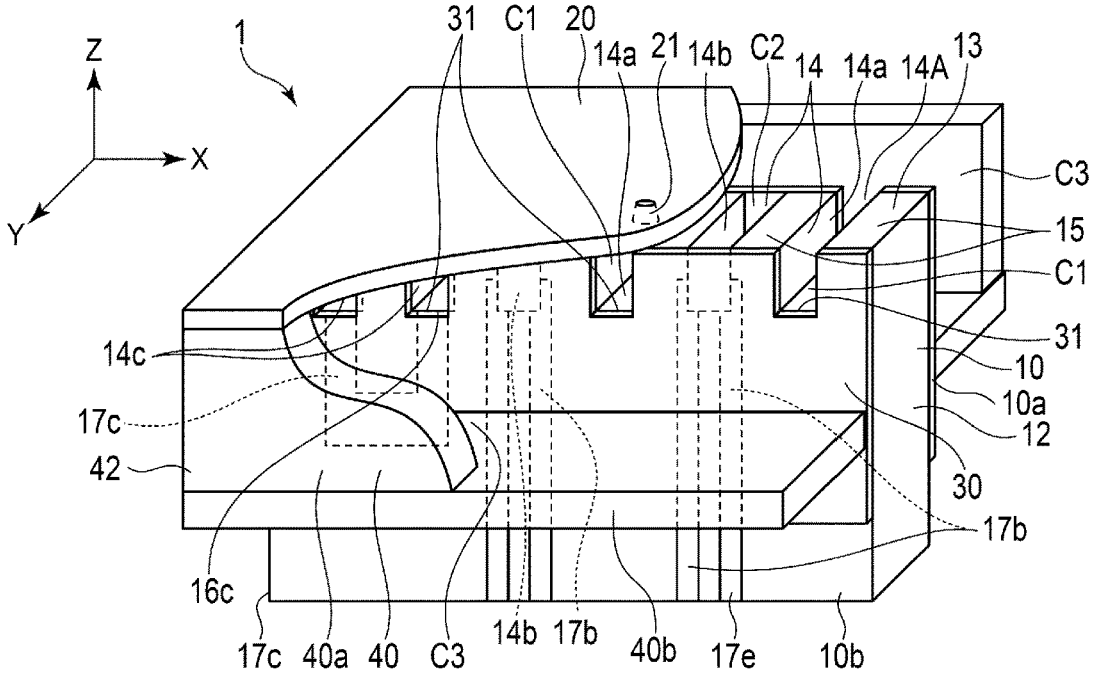
FIG. 2 is a partially cutaway perspective view illustrating an internal structure of the inkjet head.
Figure 3:
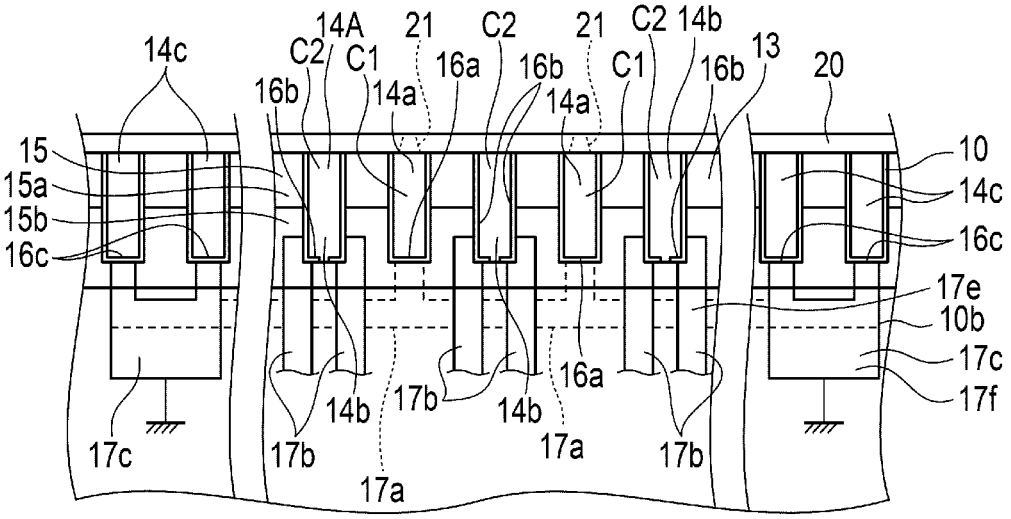
FIG. 3 is an explanatory diagram of the inkjet head.
Figure 4:
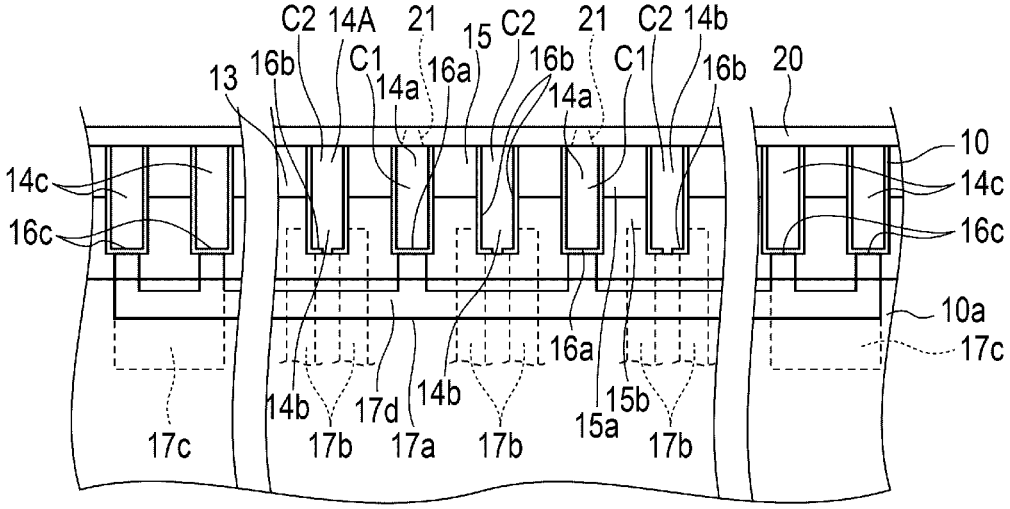
FIG. 4 is an explanatory diagram of the inkjet head.

FIG. 1 is a perspective view of the inkjet head 1. FIG. 2 is an explanatory diagram illustrating a part of the inkjet head 1. FIG. 3 is a side view from one principal plane side of a base 10. FIG. 4 is a side view from the other principal plane side of the base 10.

The inkjet head 1 illustrated in FIGS. 1 to 4 is an inkjet head of a share-mode shared-wall scheme of a so-called end shooter type.

The inkjet head 1 includes the base 10, a nozzle plate 20 including a plurality of nozzles 21, a cover plate 30, which is a cover, and a case member 40.

The base 10 includes a substrate 12 and a laminated piezoelectric body 13, which is a piezoelectric section.

The substrate 12 is formed in a square plate shape. The substrate 12 is desirably formed of PZT, ceramics, glass, free-cutting ceramics, or a material including PZT, ceramics, glass, or free-cutting ceramics. The laminated piezoelectric body 13 is connected to the end edge on the nozzle plate 20 side of the substrate 12.

The laminated piezoelectric body 13 is formed by laminating two piezoelectric members. The piezoelectric members are formed of, for example, a PZT (lead zirconate titanate)-based ceramics material. Besides, as the piezoelectric members, lead-free piezoelectric ceramics such as KNN (sodium potassium niobate) may be used in consideration of environment. The two piezoelectric members are polarized to have opposite polarization directions and bonded via an adhesive layer.

A groove row 14A including a plurality of grooves 14 disposed side by side in a first direction is formed on an end face of the laminated piezoelectric body 13 opposed to the nozzle plate 20. The plurality of grooves 14 are bottomed slits opened on the nozzle plate 20 side and having a predetermined depth. A cross section along an XZ plane of the laminated piezoelectric body 13 has a comb teeth shape. Support-like portions formed among the grooves 14 adjacent to one another form laminated piezoelectric elements 15 functioning as driving sections that change the volume of the grooves 14.

That is, on one end side of the base 10, a plurality of elongated laminated piezoelectric elements 15 are disposed side by side in the first direction via the plurality of grooves 14. The laminated piezoelectric elements 15 include first piezoelectric elements 15*a* and second piezoelectric elements 15*b* laminated each other. The second piezoelectric elements 15*b* are continuous on the bottom side of the grooves 14.

The plurality of grooves 14 are formed by a plurality of first grooves 14*a* disposed side by side in the first direction, a plurality of second grooves 14*b* disposed among the plurality of first grooves 14*a*, and a plurality of third grooves 14*c* disposed at both end portions of the groove row 14A. The pluralities of grooves 14*a*, 14*b*, 14*c* respectively extend along the second direction and the third direction orthogonal to the first direction and are formed in parallel to one another. The grooves 14*a*, 14*b*, and 14*c* are formed over the entire length in the second direction of the base 10.

A plurality of common electrodes 16*a* are formed on the inner walls of the first grooves 14*a*. The common electrodes 16*a* are, for example, metal films formed on the bottom walls and the side walls of the first grooves 14*a*. The common electrodes 16*a* are connected to a plurality of common patterns 17*a* formed on the other principal plane 10*a* of the base 10. Both ends in the second direction of the first grooves 14*a* are opened on the inner side of a frame member 40*a* to communicate with a common chamber C3. The nozzles 21 are provided in positions opposed to the first grooves 14*a*. That is, the first grooves 14*a* form a plurality of pressure chambers C1 that communicate with the common chamber C3 and communicate with the nozzles 21.

Pairs of individual electrodes 16*b* are formed on the inner walls of the second grooves 14*b*. The pairs of individual electrodes 16*b* are connected to a plurality of individual patterns 17*b* formed on one principal plane 10*b* of the base 10. Both end portions in the second direction of the second grooves 14*b* are covered by the cover plate 30 in the frame member 40*a*. The second grooves 14*b* are closed to form a plurality of air chambers C2 separated from the common chamber C3 and the pressure chambers C1.

Pairs of connection electrodes 16*c* are formed on the inner walls of the third grooves 14*c*. The connection electrodes 16*c* are connected to the common patterns 17*a* on the other side of the base 10 and a pair of connection patterns 17*c* on one side of the base 10.

Predetermined wiring patterns 17 (wiring electrodes) are formed on a pair of principal planes 10*a* and 10*b* of the base 10. The wiring patterns 17 include the common patterns 17*a*, the individual patterns 17*b*, and the connection patterns 17*c*.

The common patterns 17*a* are metal films formed on the other principal plane 10*a* of the base 10. The common patterns 17*a* include predetermined wiring patterns connected to the plurality of common electrodes 16*a* disposed in parallel and the connection electrodes 16*c* disposed at end portions. A common wire 17*d* formed from the inner walls of the plurality of first grooves 14*a* to the other principal plane 10*a* of the base 10 is formed by the plurality of common electrodes 16*a* and the common patterns 17*a*.

The plurality of individual patterns 17*b* are metal films formed on one principal plane 10*b* of the base 10. The plurality of individual patterns 17*b* include predetermined wiring patterns respectively connected to the plurality of individual electrodes 16*b*. The individual patterns 17*b* extend to the outer side of the frame member 40*a* on the other principal plane 10*a* to be connected to a driving circuit 52 via a flexible board 51. A plurality of individual wires 17*e* formed from the inner walls of the plurality of second grooves 14*b* to one principal plane 10*b* of the base 10 are formed by the individual patterns 17*b* and the individual electrodes 16*b*.

The pair of connection patterns 17*c* is metal films formed on one principal plane 10*b* of the base 10. The pair of connection patterns 17*c* includes predetermined wiring patterns respectively connected to the pairs of connection electrodes 16*c*. The connection patterns 17*c* extend to the outer side of the frame member 40*a* on one principal plane 10*b* to be grounded. The connection patterns 17*c* are connected to the common patterns 17*a* on the other principal plane 10*a* via the connection electrodes 16*c*. The connection electrodes 16*c* and the connection patterns 17*c* form connection wires 17*f* leading from the other side to one principal plane 10*b*.

The common electrodes 16*a*, the individual electrodes 16*b*, the connection electrodes 16*c*, the common patterns 17*a*, the individual patterns 17*b*, the connection patterns 17*c* are formed by a method such as a vacuum vapor deposition method or an electroless nickel plating method and patterned into predetermined shapes by etching or laser machining.

The nozzle plate 20 is formed in a square plate shape having thickness of approximately 10 μm to 100 μm. A nozzle row including the plurality of nozzles 21 piercing through the nozzle plate 20 in the thickness direction is formed on the nozzle plate 20. The nozzle plate 20 is disposed to be opposed to openings of the groove row 14A on one end side of the base 10 to cover the openings. The nozzles 21 are respectively provided in positions corresponding to the plurality of pressure chambers C1. That is, the nozzle plate 20 includes the nozzles 21 that communicate with the pressure chambers C1 formed by the first grooves 14*a* and closes openings of the second grooves 14*b* and the third grooves 14*c*.

The cover plate 30 is made of a material such as ceramics or glass. The cover plate 30 is a square tabular member including a plurality of cutout sections 31. The cover plate 30 covers predetermined regions including openings at end portions of the second grooves 14*b*. The cutout sections 31 are formed to pierce through the base 10 in the thickness direction. Since the cutout sections 31 correspond to the positions of the first grooves 14*a* and the third grooves 14*c*, both ends in the second direction of the first grooves 14*a* and the third grooves 14*c* are opened on the inside of the frame member 40*a* without being covered by the cover plate 30. Therefore, the pressure chambers C1 formed by the first grooves 14*a* communicate with the common chamber C3 formed on the outer side of the cover plate 30. Fluid such as ink flows into the pressure chambers C1 through the cutout sections 31. On the other hand, openings at both ends in the second direction of the second grooves 14*b* are closed by the cover plates 30. Inflow of the ink is prevented.

That is, the pressure chambers C1 communicating with the common chamber C3 and the closed air chambers C2 are alternately formed on one end side of the base 10. The third grooves 14*c*, in which the connection electrodes 16*c* are formed, are disposed at both ends of the groove row 14A.

The case member 40 integrally includes the frame member 40*a* formed in a square frame shape and a plate-like lid member 40*b* that closes an opening of the frame member 40*a*. The frame member 40*a* surrounds the outer circumference of the base 10 and covers the outer circumference of a part of the region of the base 10. Specifically, the frame member 40*a* includes a plate-like pair of first frame pieces 41 joined to an end face in the first direction of the base 10 and a plate-like pair of second frame pieces 42 disposed a predetermined distance apart from each other on both the principal planes 10*a* and 10*b*, which are the outer surface of the base 10. The frame member 40*a* forms the common chamber C3 between the frame member 40*a* and the base 10 covered by the cover plate 30. The common chamber C3 communicates with the pressure chambers C1 through the cutout sections 31 of the cover plate 30. The frame member 40*a* plays a guide function for guiding fluid such as ink. An end edge, which is an opening edge, on one side of the frame member 40*a* is joined to the outer circumference of the nozzle plate 20. The lid member 40*b* is provided at an end edge, which is an opening edge, on the other side of the frame member 40*a*.

The lid member 40*b* is configured integrally with the frame member 40*a*. The lid member 40*b* is a rectangular tabular member including supply ports for causing the ink to flow into the common chamber C3 from the outside and discharge ports for discharging the ink to the outside from the common chamber C3. Supply channels 133*a* are connected to the supply ports. Collection channels 133*b* are connected to the discharge ports. The lid member 40*b* closes one side of the opening of the frame member 40*a* to form the common chamber C3.

That is, an actuator portion, which is a portion on the nozzle plate 20 side of the base 10, is covered by the nozzle plate 20, the frame member 40*a*, and the lid member 40*b*. Various electronic components such as driving circuits are mounted on the wiring patterns 17 in a portion extending to the outer side of the frame member 40*a* and the lid member 40*b* on the opposite side of the nozzle plate 20 in the base 10.

The plurality of pressure chambers C1 communicating with the nozzles 21, the plurality of air chambers C2 closed by the cover plate 30, and the common chamber C3 communicating with the plurality of pressure chambers C1 are formed on the inside of the frame member 40*a* of the inkjet head 1 configured as explained above. The inkjet head 1 circulates the ink in a channel passing through the pressure chambers C1 and the common chamber C3 formed on the inside.

Figure 5:
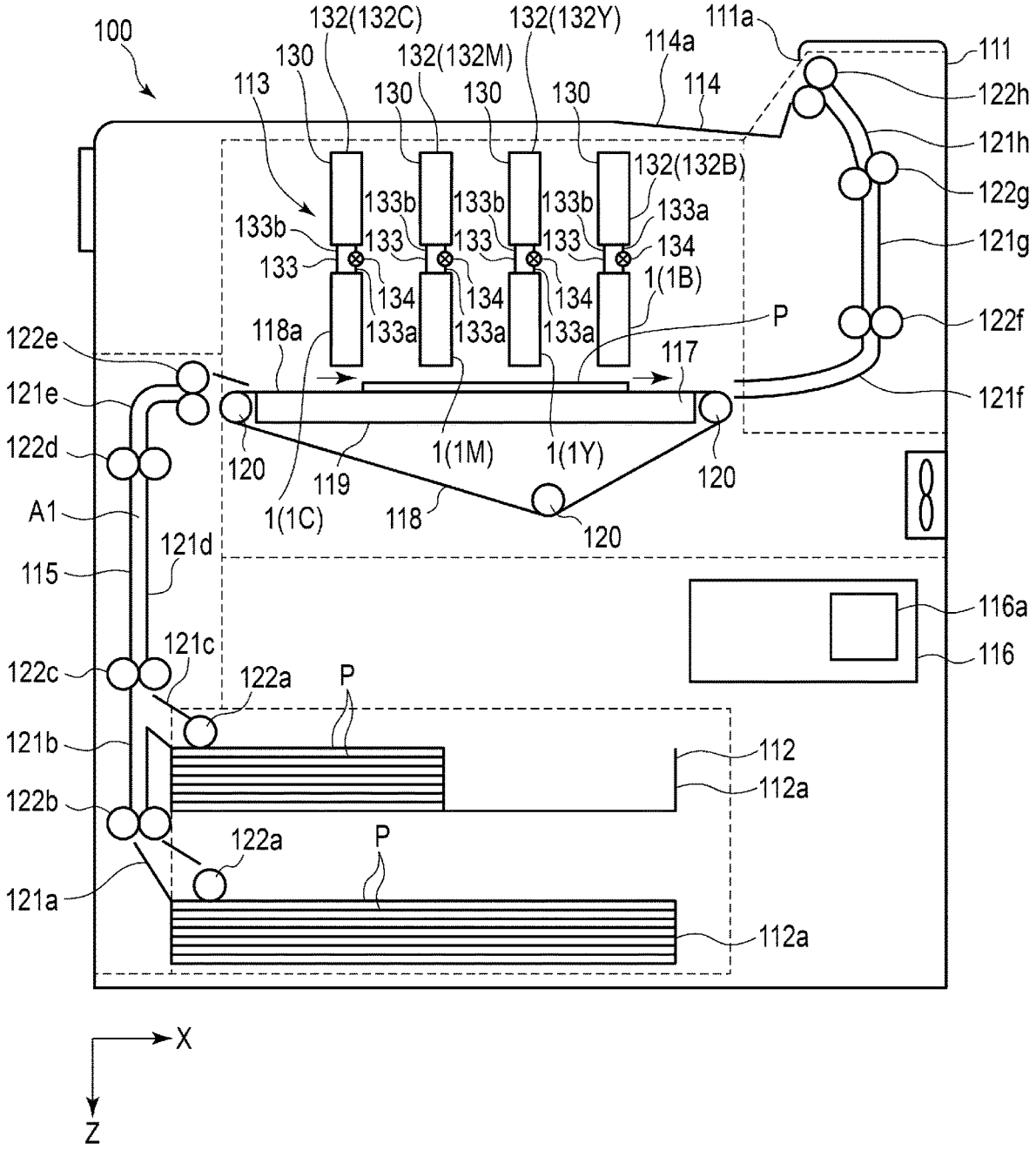
FIG. 5 is an explanatory diagram illustrating the configuration of an inkjet printer including the inkjet head.

The inkjet printer 100 including the inkjet head 1 is explained below with reference to FIG. 5. FIG. 5 is an explanatory diagram illustrating the configuration of the inkjet printer 100. As illustrated in FIG. 5, the inkjet printer 100 includes a housing 111, a medium supplying section 112, an image forming section 113, a medium discharging section 114, a conveying device 115, and a control section 116.

The inkjet printer 100 is a fluid discharge apparatus that discharges fluid such as ink while conveying, for example, paper P as a recording medium, which is a discharge target object, along a predetermined conveyance path A1 leading from the medium supplying section 112 to the medium discharging section 114 through the image forming section 113 to perform image formation processing on the paper P.

The medium supplying section 112 includes a plurality of paper feeding cassettes 112*a*. The medium discharging section 114 includes a paper discharge tray 114*a*. The image forming section 113 includes a supporting section 117 that supports paper and a plurality of head units 130 disposed to be opposed to one another above the supporting section 117.

The supporting section 117 includes a conveyance belt 118 provided in a loop shape in a predetermined region where image formation is performed, a support plate 119 that supports the conveyance belt 118 from the rear side, and a plurality of belt rollers 120 provided on the rear side of the conveyance belt 118.

The head units 130 include a plurality of inkjet heads 1, a plurality of ink tanks 132 respectively mounted on the inkjet heads 1, connection channels 133 that connect the inkjet heads 1 and the ink tanks 132, and circulation pumps 134, which are circulating sections. The head units 130 are head units of a circulation type that circulate fluid.

In the embodiment, the inkjet printer 100 includes inkjet heads 1C, 1M, 1Y, and 1K of four colors of cyan, magenta, yellow, and black as the inkjet heads 1 and includes ink tanks 132C, 132M, 132Y, and 132K as the ink tanks 132 that respectively store inks of these colors. The ink tanks 132 are connected to the inkjet heads 1 by the connection channels 133. The connection channels 133 include the supply channels 133*a* connected to the supply ports of the inkjet heads 1 and the collection channels 133*b* connected to the discharge ports of the inkjet heads 1.

Not-illustrated negative-pressure control devices such as pumps are coupled to the ink tanks 132. Negative pressure control is performed in the ink tanks 132 by the negative-pressure control devices according to water head values of the inkjet heads 1 and the ink tanks 132 to form, as meniscuses having a predetermined shape, inks supplied to the nozzles of the inkjet heads 1.

The circulation pumps 134 are, for example, liquid feeding pumps configured by piezoelectric pumps. The circulation pumps 134 are provided in the supply channels 133*a*. The circulation pumps 134 are connected to a driving circuit of the control section 116 by wires and configured to be controllable by control by a CPU (Central Processing Unit) 116*a*. The circulation pumps 134 circulate fluid in circulation channels including the inkjet heads 1 and the ink tanks 132.

The conveying device 115 conveys the paper P along the conveyance path A1 leading from the paper feeding cassettes 112*a* of the medium supplying section 112 to the paper discharge tray 114*a* of the medium discharging section 114 through the image forming section 113. The conveying device 115 includes a plurality of guide plate pairs 121*a* to 121*h* and a plurality of conveyance rollers 122*a* to 122*h* disposed along the conveyance path A1.

The control section 116 includes the CPU (Central Processing Unit) 116*a*, which is a controller, a ROM (Read Only Memory) that stores various computer programs and the like, a RAM (Random Access Memory) that temporarily stores various variable data, image data, and the like, and an interface section that receives an input of data from the outside and outputs data to the outside.

Figure 6:
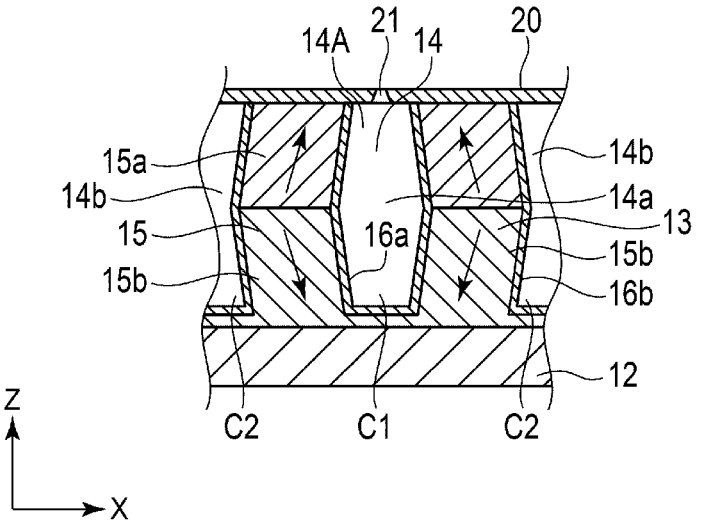
FIG. 6 is an explanatory diagram illustrating the operation of the inkjet head.
Figure 7:
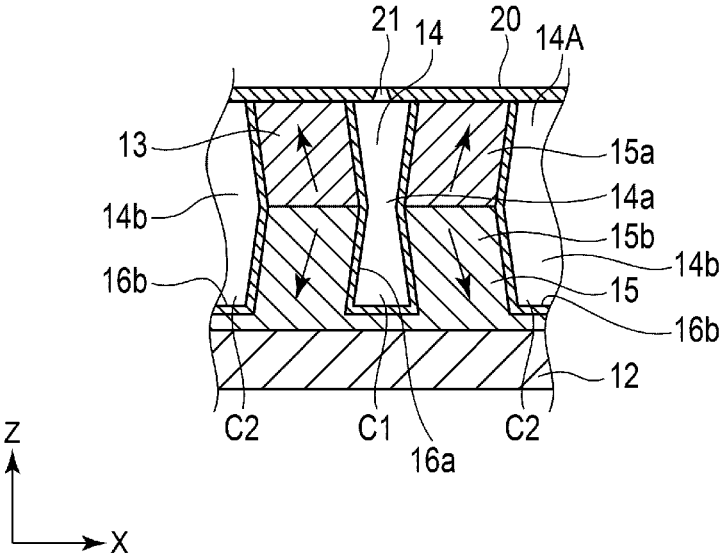
FIG. 7 is an explanatory diagram illustrating the operation of the inkjet head.

In the inkjet head 1 and the inkjet printer 100, at driving time when fluid is ejected from the nozzles 21, the control section 116 applies, with the driving circuit 52, a driving voltage via the plurality of individual wires 17*e*. If a potential difference is applied to an electrode in the pressure chamber C1 to be driven by the application of the driving voltage and electrodes in the air chambers C2 on both sides of the pressure chamber C1, the first piezoelectric elements 15*a* and the second piezoelectric elements 15*b* are deformed in opposite directions each other. Driving elements are flexurally deformed by the deformation of both the piezoelectric elements. For example, as illustrated in FIG. 6, first, the pressure chamber C1 to be driven is deformed in an opening direction to generate a negative pressure in the pressure chamber C1 to lead ink from the cutout sections 31 into the pressure chamber C1. Subsequently, as illustrated in FIG. 7, the pressure chamber C1 is deformed in a closing direction and the inside of the pressure chamber C1 is pressurized to eject ink droplets from the nozzles 21.

In the inkjet head land the inkjet printer 100 according to this embodiment, wiring and packaging can be simplified by drawing out the individual patterns 17*b* and the common patterns 17*a* respectively to one side and the other side in the second direction from the alternately disposed pressure chambers C1 and air chambers C2. That is, the number of terminals can be reduced and a wiring pitch can be increased by leading out the individual patterns 17*b* and the common patterns 17*a* to opposite sides and collecting the plurality of common patterns 17*a* led out to the other side. A configuration with excellent packaging properties can be realized by drawing out the connection patterns 17*c*, which are connected to the common patterns 17*a*, to the same surface as the individual patterns 17*b*. The common wire 17*d* formed in the pressure chambers C1, into which ink flows, is grounded. The individual wires 17*e*, to which a voltage is applied, are formed in the closed air chambers C2. Consequently, it is possible to prevent a discharge failure due to a flow of an electric current to conductive water-based ink.

The third grooves 14*c* can be simultaneously formed on the same end face in a groove forming step for forming the first grooves 14*a* and the second grooves 14*b*. The connection electrodes 16*c* can be formed simultaneously with a step for forming the individual electrodes 16*b* and the common electrodes 16*a*. Further, the connection patterns 17*c* can be simultaneously formed in a step for forming the common patterns 17*a* and the individual patterns 17*b*.

Embodiments are not limited to the first embodiment per se. In an implementation stage, the constituent elements can be modified and embodied without departing from the spirit of the present invention.

In the first embodiment, the example is explained in which the laminated piezoelectric body 13 including the groove row 14A is disposed at the end edge portion of the substrate 12. However, embodiments are not limited to this. The number of nozzle rows is not limited to the number of nozzle rows in the first embodiment. The inkjet head 1 may include two or more nozzle rows.

Figure 8:
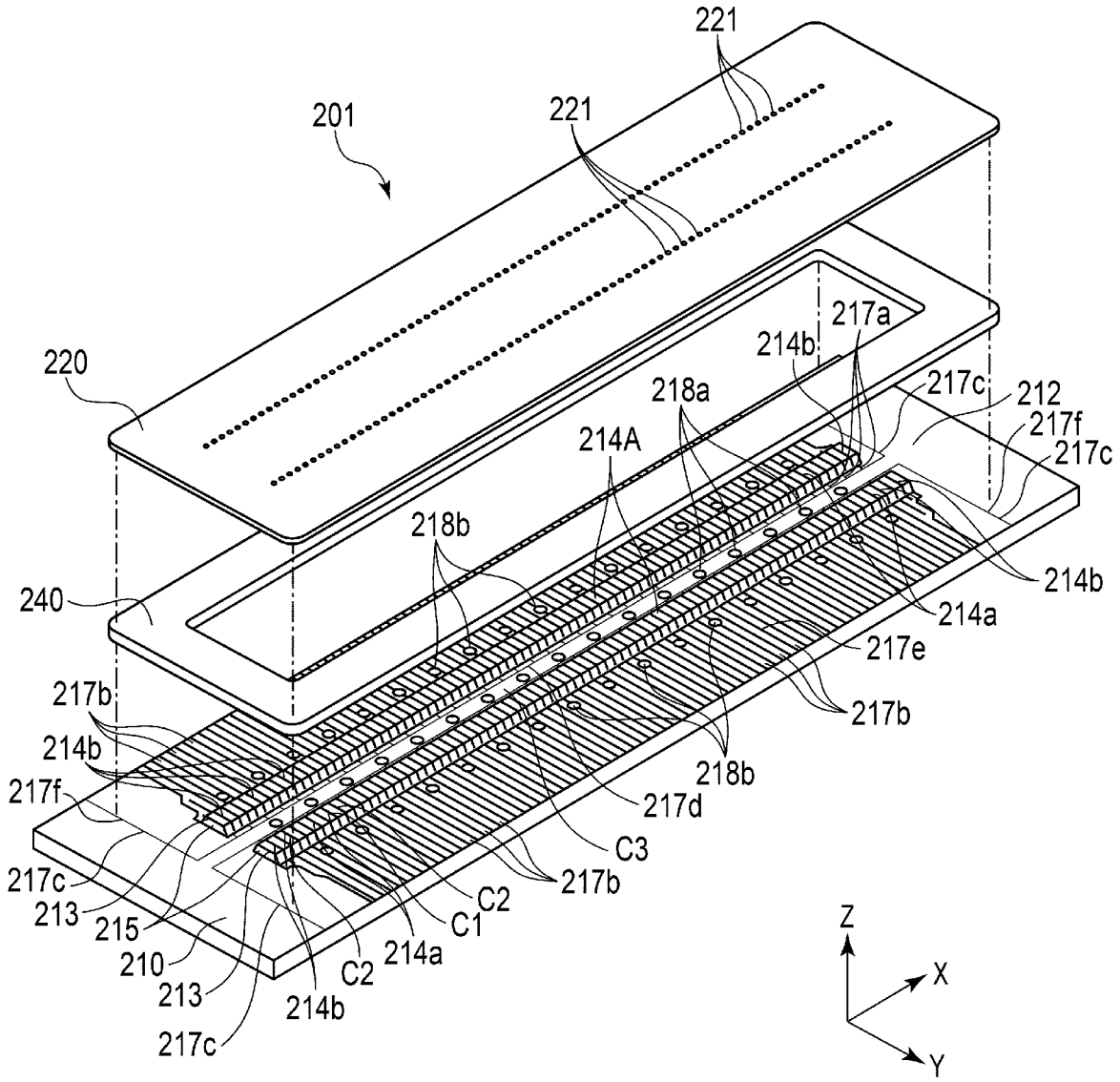
FIG. 8 is an explanatory diagram of an inkjet head according to another embodiment.

For example, in an inkjet head 201 according to another embodiment, as illustrated in FIG. 8, a laminated piezoelectric body 213 is formed on a substrate 212. The inkjet head 201 includes a base 210, a nozzle plate 220 including a plurality of nozzles 221, and a frame member 240.

The base 210 includes the substrate 212 and the laminated piezoelectric body 213 provided on the substrate 212. The laminated piezoelectric body 213 includes two groove rows 214A including first grooves 214*a* and second grooves 214*b* and includes a plurality of piezoelectric element sections 215 disposed side by side in the first direction.

The substrate 212 is a rectangular tabular member including supply ports 218*a* for causing ink to flow into the common chamber C3 from the outside and discharge ports 218*b* for discharging the ink to the outside from the common chamber C3. The nozzle plate 220 is disposed to be opposed to the base 210. The frame member 240 is disposed between the base 210 and the nozzle plate 220. Consequently, the common chamber C3 is formed in the inkjet head 201.

Both ends in a Y direction, which is the second direction, of the first grooves 214*a* are opened to form the pressure chambers C1 that communicate with the common chamber C3. Both end portions in the Y direction of the second grooves 214*b* are closed to form the air chambers C2. Common electrodes are formed on the inner walls of the first grooves 214*a*. Individual electrodes are formed on the inner walls of the second grooves 214*b*.

In this embodiment, a common wire 217*d* including common electrodes and common patterns 217*a* is extended from the first grooves 214*a* to a side on the other side on the substrate 212. Individual wires 217*e* configured by individual electrodes and individual patterns 217*b* are extended from the second grooves 214*b* to one side on the substrate 212. Connection wires 217*f* including connection patterns 217*c* are connected to the common wire 217*d* on the other side of the groove row 214A and drawn out to one side of the groove row 214A. That is, the common electrodes are drawn out to the same side as the individual wires 217*e* by the common patterns 217*a* and the connection patterns 217*c*. The other components are the same as the components of the inkjet head 1 according to the first embodiment. For example, the inkjet head 201 is provided in the inkjet printer 100 illustrated in FIG. 5. The supply ports 218*a* are connected to the supply channels 133*a*. The discharge ports 218*b* are connected to the collection channels 133*b*.

In this embodiment, as in the first embodiment, the individual electrodes are extended to one side of the groove row 214A and the common electrodes are extended to the other side. Therefore, the number of terminals can be reduced and a wiring pitch can be increased by collecting the common patterns 217*a*. The common electrodes are dawn out to the same one side as the individual electrodes by the common patterns 217*a* and the connection wires 217*f* through the end portion of the groove row 214A. Therefore, packaging is easy. The common electrodes to be grounded are disposed in the pressure chambers C1 into which the ink flows. The individual electrodes, to which a voltage is applied, are formed in the closed air chambers C2. Therefore, deficiencies due to a flow of an electric current to the ink can be prevented.

Figure 9:
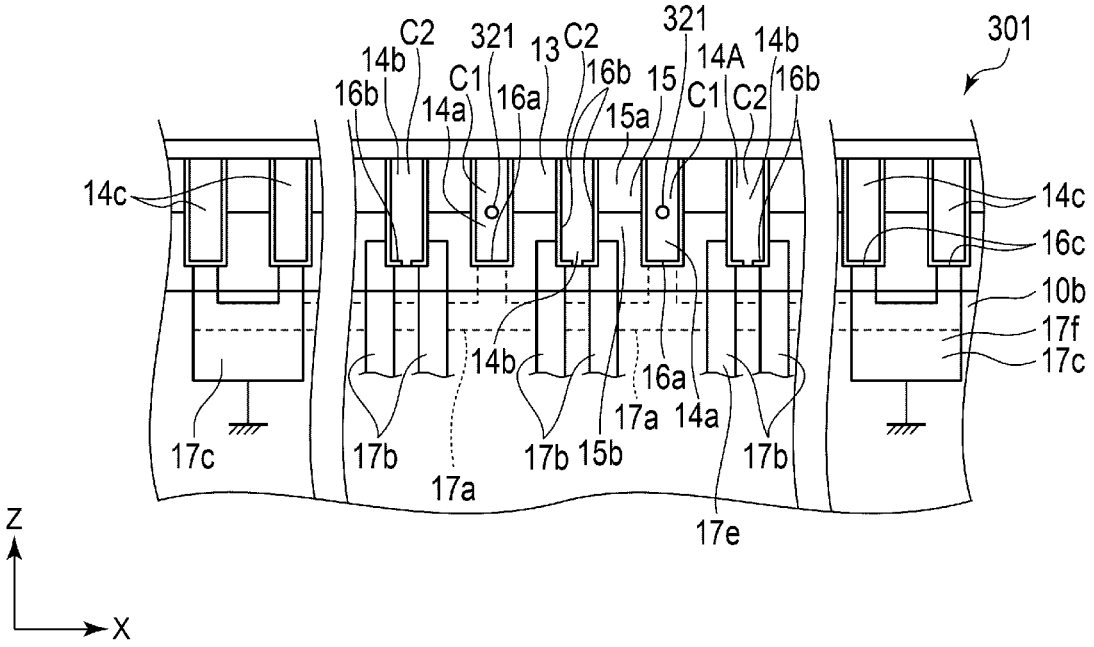
FIG. 9 is an explanatory diagram of an inkjet head according to another embodiment.

In the first embodiment, the inkjet head 1 of the so-called end shooter type is illustrated. However, embodiments are not limited to this. For example, as another embodiment, embodiments may be applied to an inkjet head 301 of a side shooter type illustrated in FIG. 9. In the inkjet head 301, a nozzle plate including nozzles 321 is disposed at an end portion in the Y direction. The other components are the same as the components of the inkjet head 1 according to the first embodiment. In this embodiment, the same effect as the effect in the first embodiment can be obtained.

Figure 10:
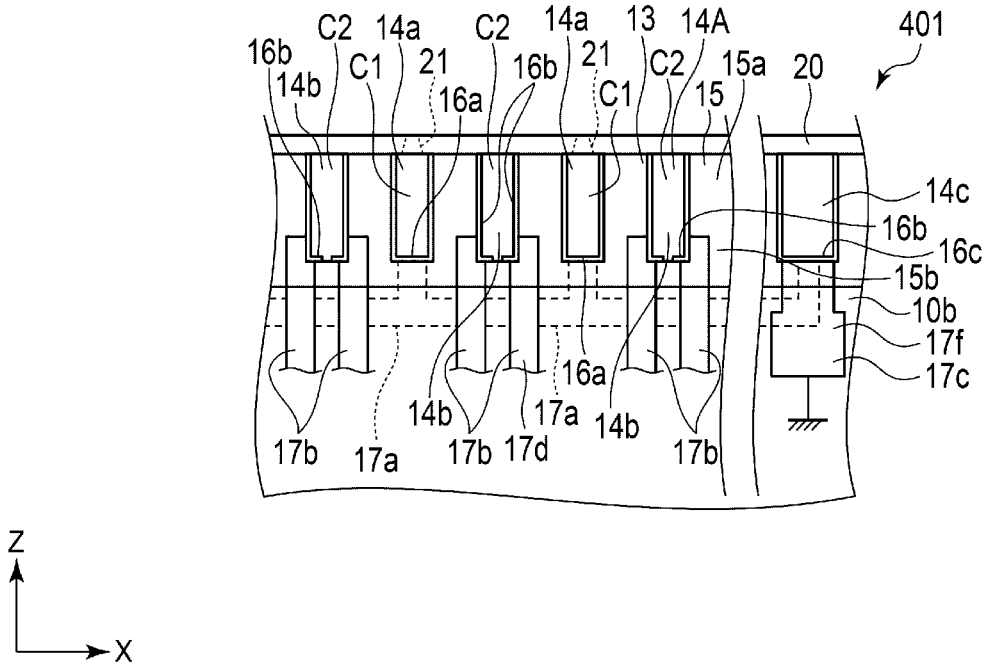
FIG. 10 is an explanatory diagram of an inkjet head according to another embodiment.

In the first embodiment, the configuration is illustrated in which the connection wires 17*f* are connected through the two third grooves 14*c* formed at each of both the ends of the groove row 14A. However, embodiments are not limited to this. The third grooves 14*c* may be formed only on one end side of the groove row 14A. Only one or three or more third grooves 14*c* may be formed. For example, as another embodiment, in an inkjet head 401 illustrated in FIG. 10, only one third groove 14*c* is provided on one end side of the groove row 14A. Dimensions such as the width of the connection wires 17*f* are adjusted as appropriate according to, for example, the number and the positions of grooves. In this embodiment, the same effect as the effect in the first embodiment can be obtained.

Figure 11:
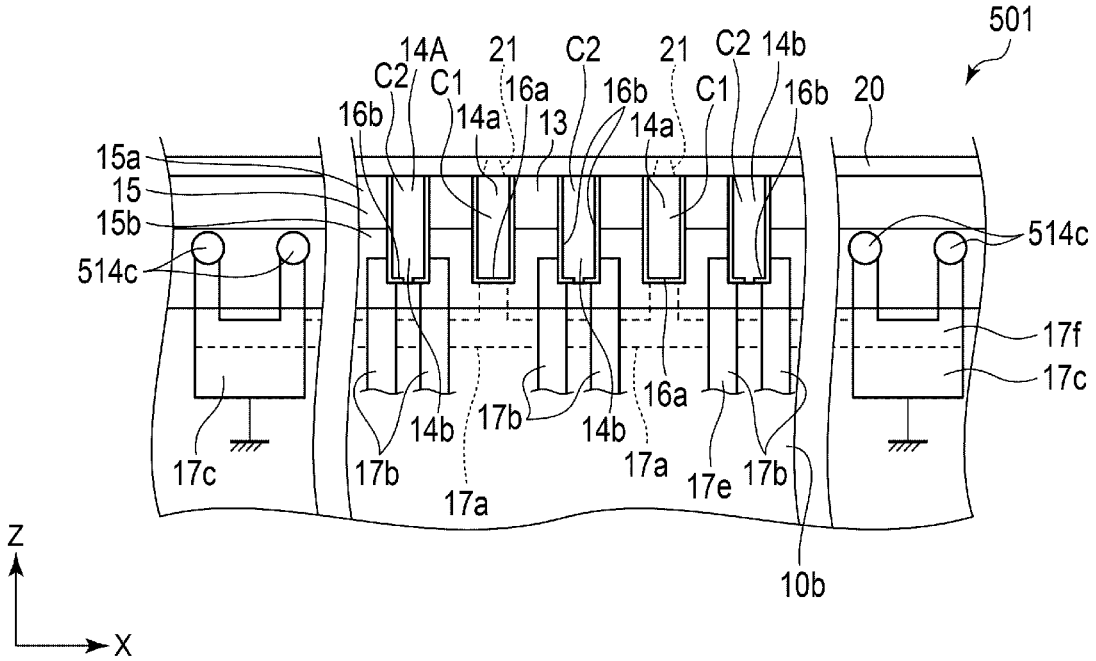
FIG. 11 is an explanatory diagram of an inkjet head according to another embodiment.

A component for drawing out the wires on the common side to one side is not limited to the grooves 14*c*. The wires may be drawn out via, for example, through-holes or through-vias. For example, as another embodiment, an inkjet head 501 illustrated in FIG. 11 includes through-holes 514*c* that pierce through the base 10 in the second direction. In the inkjet head 501, the connection electrodes 16*c* are formed in the through-holes 514*c*. The connection wires 17*f* are drawn out from the other side to one side via the through-holes 514*c*. The other components are the same as the components of the inkjet head 1 according to the first embodiment. In this embodiment, the same effect as the effect in the first embodiment can be obtained.

In the first embodiment, the base 10 including, on the substrate 12, the laminated piezoelectric body 13 formed by the piezoelectric members is illustrated. However, embodiments are not limited to this. For example, the base 10 may be formed by only the piezoelectric members without using a substrate. One piezoelectric member may be used rather than the two piezoelectric members.

The several embodiments are explained above. However, the embodiments are presented as examples and are not intended to limit the scope of the invention. These new embodiments can be implemented in other various forms. Various omissions, substitutions, and changes can be performed without departing from the spirit of the invention. The embodiments and modifications of the embodiments are included in the scope and the gist of the invention and included in the inventions described in claims and the scope of equivalents of the inventions.

What is claimed is:

1. A fluid discharge head, comprising:

a base comprising a groove row comprising a plurality of first grooves disposed side by side in a first direction and a plurality of second grooves disposed side by side in the first direction and respectively disposed among the plurality of first grooves, the first grooves and the second grooves extending along a second direction crossing the first direction; and a nozzle plate comprising nozzles that communicate with the first grooves of the base, characterized by further comprising:

an individual wire comprising individual electrodes formed in the second grooves, the individual wire being extended to a first side of the groove row in the second direction;

a common wire comprising common electrodes formed in the first grooves, the common wire being extended to a second side of the groove row in the second direction; and a connection wire connected to the common wire on the second side of the groove row in the second direction and leading to the first side of the groove row.

2. The head according to claim 1, wherein the plurality of first grooves and the plurality of second grooves are bottomed slits opened on a nozzle plates side and having a predetermined depth in a third direction orthogonal to the first direction and the second direction, and the nozzle plates is disposed to be opposed to opening of the groove row on an end face on a side of the base to cover the openings, the individual wire extends from the end face to one principal plane in the second direction of the base, the common wire extends from the end face to another principal plane in the second direction of the base, and the connection wire extends from the common wire to the one principal plane through one or more third grooves extending in the second direction and formed at an end portion of the groove row in the first direction on the end face of the base.

3. The head according to claim 1, wherein the first grooves and the second grooves are bottomed slits opened on a nozzle slide plate and having a predetermined depth in a third direction orthogonal to the first direction and the second direction, and the nozzle plate is disposed to be opposed to opening of the groove row on an end face on a side of the base to cover the openings, the individual wire extends from the end face to one principal plane in the second direction of the base, the common wire extends from the end face to another principal plane in the second direction of the base, and the connection wire extends from the common wire to the one principal plane through a through-hole that pierces through the base in the second direction.

4. The head according to claim 3, wherein the base comprises a laminated piezoelectric body on a substrate.

5. The head according to claim 1, further comprising:

a frame member comprising frame pieces disposed to be opposed to an outer surface of the base, a common chamber formed between the frame member and the base; and a cover configured to cover openings at end portions in the second direction of the second grooves, wherein the first grooves form pressure chambers that communicate with the nozzles and communicate with the common chamber, and the second grooves form air chambers adjacent to the pressure chambers and separated from the common chamber by the cover.

6. The head according to claim 1, wherein the base comprises a laminated piezoelectric body on a substrate.

7. The head according to claim 6, wherein the substrate comprises a plurality of supply ports for causing ink to flow into a common chamber.

8. The head according to claim 1, wherein at least one of the common electrodes is grounded.

9. The head according to claim 1, wherein the base comprises a substrate and a laminated piezoelectric body connected to an end edge on a nozzle plate side of the substrate; and the groove row is formed on an end face of the laminated piezoelectric body opposed to the nozzle plate.

10. An inkjet head, comprising:

a base comprising a groove row comprising a plurality of first grooves disposed side by side in a first direction and a plurality of second grooves disposed side by side in the first direction and respectively disposed among the plurality of first grooves, the first grooves and the second grooves extending along a second direction crossing the first direction; and a nozzle plate comprising nozzles that communicate with the first grooves of the base, characterized by further comprising:

an individual wire comprising individual electrodes formed in the second grooves, the individual wire being extended to a first side of the groove row in the second direction;

a common wire comprising common electrodes formed in the first grooves, the common wire being extended to a second side of the groove row in the second direction; and a connection wire connected to the common wire on the second side of the groove row in the second direction and leading to the first side of the groove row.

11. The inkjet head according to claim 10, wherein the inkjet head is a shooter type inkjet head.

12. The inkjet head according to claim 10, wherein the inkjet head is a side shooter type inkjet head.

13. An inkjet printer, comprising:

a base comprising a groove row comprising a plurality of first grooves disposed side by side in a first direction and a plurality of second grooves disposed side by side in the first direction and respectively disposed among the plurality of first grooves, the first grooves and the second grooves extending along a second direction crossing the first direction; and a nozzle plate comprising nozzles that communicate with the first grooves of the base, characterized by further comprising an individual wire comprising individual electrodes formed in the second grooves, the individual wire being extended to a first side of the groove row in the second direction;

a common wire comprising common electrodes formed in the first grooves, the common wire being extended to a second side of the groove row in the second direction;

a connection wire connected to the common wire on the second side of the groove row in the second direction and leading to the first side of the groove row;

and a conveying device configured to convey a medium along a predetermined conveyance path.

14. The inkjet printer according to claim 13, wherein the plurality of first grooves and the plurality of second grooves are bottom slits opened on a nozzle plate side and having a predetermined depth in a third direction orthogonal to the first direction and the second direction, and the nozzle plate is disposed to be opposed to openings of the groove row on an end face on a side of the base to cover the openings, the individual wire extends from the end face to one principal plane in the second direction of the base, the common wire extends from the end face to another principal plane in the second direction of the base, and the connection wire extends from the common wire to the one principal plane through one or more third grooves extending in the second direction and formed at an end portion of the groove row in the first direction on the end face of the base.

15. The inkjet printer according to claim 13, wherein the first grooves and the second grooves are bottomed slits opened on a nozzle plate side and having a predetermined depth in a third direction orthogonal to the first direction and the second direction, and the nozzle plate is disposed to be opposed to openings of the groove row on an end face on a side of the base to cover the openings, the individual wire extends from the end face to one principal plane in the second direction of the base, the common wire extends from the end face to another principal plane in the second direction of the base, and the connection wire extends from the common wire to the one principal plane through a through-hole that pierces through the base in the second direction.

16. The inkjet printer according to claim 13, wherein a groove row comprising the first grooves and the second grooves is formed on the base, the individual wire extends to a side on a first side of the groove row, the common wire extends to a side on a second side of the groove row, and the connection wire leads from the side on the other side of the groove row to the side on the first side of the groove row through an end portion in the first direction of the groove row.

17. The inkjet printer according to claim 13, further comprising:

a frame member comprising frame pieces disposed to be opposed to an outer surface of the base, a common chamber formed between the frame member and the base; and a cover configured to cover openings at end portions in the second direction of the second grooves, wherein the first grooves form pressure chambers that communicate with the nozzles and communicate with the common chamber, and the second grooves form air chambers adjacent to the pressure chambers and separated from the common chamber by the cover.

18. The inkjet printer according to claim 13, wherein the base comprises a laminated piezoelectric body on a substrate.

19. The inkjet printer according to claim 18, wherein the substrate comprises a plurality of supply ports for causing ink to flow into a common chamber.

20. The inkjet printer according to claim 13, wherein at least one of the common electrodes is grounded.

* * * * *